United States Patent [19]

Sakoda

[11] 4,341,409

[45] Jul. 27, 1982

[54] DOOR LATCHING ASSEMBLY

[75] Inventor: Yasuhiro Sakoda, Wakayama, Japan

[73] Assignee: Sharp Kabushiki Kaisha, Osaka, Japan

[21] Appl. No.: 101,522

[22] Filed: Dec. 10, 1979

[30] Foreign Application Priority Data

Dec. 11, 1978 [JP] Japan ..... 53-153515
Feb. 28, 1979 [JP] Japan ..... 54-24877

[51] Int. Cl.[3] ..... E05C 3/34
[52] U.S. Cl. ..... 292/254; 292/DIG. 65
[58] Field of Search ..... 292/254, 26, DIG. 69, 292/DIG. 65

[56] References Cited

U.S. PATENT DOCUMENTS

| | | | |
|---|---|---|---|
| 1,701,932 | 2/1929 | Nelson | 292/26 X |
| 1,784,935 | 12/1930 | Johnson | 292/254 |
| 1,809,804 | 6/1931 | Rider | 292/254 X |
| 2,717,797 | 9/1955 | Savage | 292/254 X |
| 3,733,456 | 5/1973 | Blackburn | 292/254 X |
| 3,777,098 | 12/1973 | Tapper | 292/DIG. 68 |
| 4,109,950 | 8/1978 | Amdal | 292/254 |

FOREIGN PATENT DOCUMENTS

| | | | |
|---|---|---|---|
| 1414 | of 1913 | United Kingdom | 292/254 |

*Primary Examiner*—Richard E. Moore
*Attorney, Agent, or Firm*—Birch, Stewart, Kolasch & Birch

[57] ABSTRACT

A microwave oven comprising an oven housing, a door attached to the housing which can be operated between a closed and an opened position to provide access to the interior of said housing, a door latching assembly for securing the door in a closed position; said door latching assembly containing a locking element movably mounted on the door for locking the door in a closed position, and an unlocking element movably mounted on the door so as to shift the locking element and thereby unlock the door, and actuating means mounted on said oven housing, and operable when the door is locked to move the unlocking element to unlock the door.

4 Claims, 9 Drawing Figures

DOOR LATCHING ASSEMBLY

BACKGROUND OF THE INVENTION

The present invention relates to a door latching assembly for use in microwave ovens and the like.

A conventional door latching assembly for holding the door of a microwave oven in its closed position includes an actuator device disposed on or near a door handle for unlatching the door. After the door is unlatched, the door handle is gripped by the operator to open the door. In recent years, a new type of a microwave oven has been marketed wherein a door opening lever is provided instead on the oven body side to unlock the door and automatically urge the same in its opening direction without the need to grip the door whenever the operator desires.

OBJECTS AND SUMMARY OF THE INVENTION

Accordingly, it is an object of the present invention to provide an improvement in the above described type of a microwave oven which assures a higher degree of mechanical durability and thus reliability.

The present invention achieves the above described object by providing a door latching assembly for securing the door of an apparatus which comprises a locking element movably secured on the door for holding the door in its closed position, an unlocking element movably secured on the door for releasing the door from its closed and locked position, and an actuating element secured on the oven housing for actuating the unlocking element.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
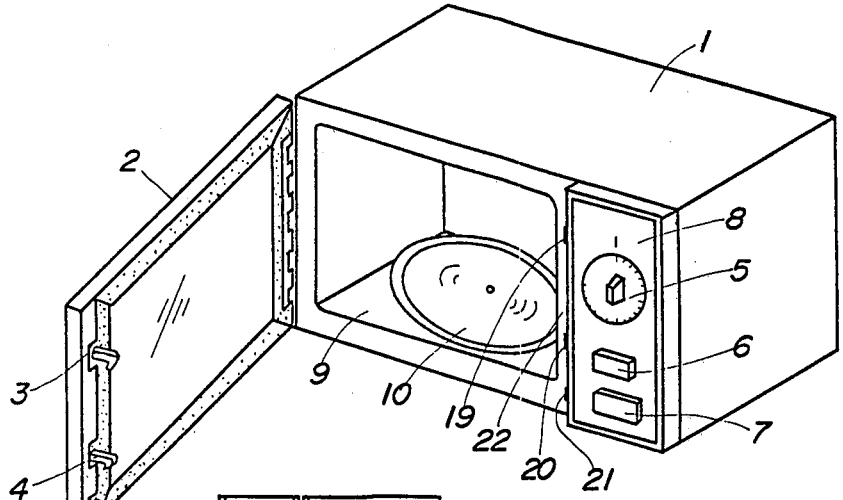
FIG. 1 is a perspective view of the outer appearance of a microwave oven equipped with a door latching assembly according to one preferred form of the present invention.

Referring now to FIG. 1, there is illustrated a perspective view of the outer appearance of a microwave oven equipped with a door latching assembly. A door 2 is rotatably cantilevered on the body of the oven and has at its right edge first and second latch heads 3 and 4 both of which have engaging hooks extending from the door 2. There is provided on the right side of the front face of the body 1 an operational panel 8 carrying a timer 5, a cook button 6, a door opening button 7, etc. When food is placed on a turntable 10 within an oven cavity 9 of the body 1, the door 2 is closed and the cook button 6 is acutated. The cooking operation then starts and continues for a predetermined period of time as determined by the timer 5.

Figure 2:
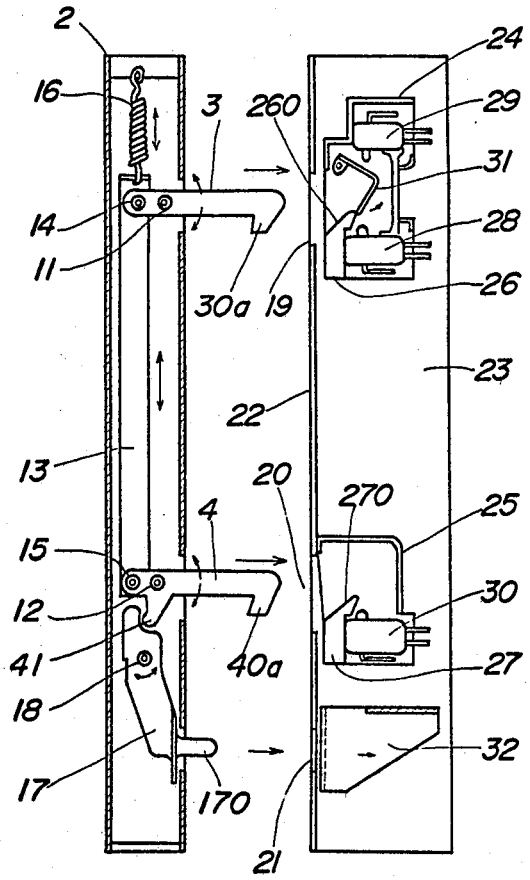
FIG. 2 is an elevational cross-sectional view of a principal part of a door locking configuration within the door latching assembly.

FIG. 2 illustrates an elevational cross-sectional view of the door latching assembly built in the microwave oven according to one preferred embodiment of the present invention. The first and second latch heads 3 and 4 are pivoted on the door 2 by means of pins 11 and 12 and are operatively associated with each other. Another pair of pins 14 and 15 connect the latch heads 3 and 4 to a connection lever 13 which is always biased upwardly under the influence of a spring 16 and movable in a vertical direction. A rotating lever 17 is movably supported on the door 2 via a pin 18 with its one end engaging a projection 41 on the second latch head 4. The lever 17 is rotatable clockwise for rotating counterclockwise the second latch head 4. The rotation of the second latch head 4 lowers the connection lever 13 and allows the first latch head 3 to rotate counterclockwise. A projection 170 is integral with the other end of the rotating lever 17 and extends from the door 2 toward the body side.

Returning to FIG. 1, openings 19, 20 and 21 are formed in a front plate 22 of the oven cavity 9 in a vertical direction so that the first and second latch heads 3 and 4 and the projection 170 on the rotating lever 17 may enter into and retrext from the body side according to the movement of the door 2.

In FIG. 2, a standing support 23 is fixed on a back wall of the front plate 22 of the oven cavity 9 and first and second switch mounts 24 and 25 are installed above and below the standing support 23. First and second latch hooks 26 and 27 are formed integrally adjacent the first and second openings 24 and 25. When the door is in its closed position, fingers **30*a* and 40*a* of the respective latch heads 3 and 4 engage with the latch hooks 26 and 27, thus locking the door 2 on the body side 1**.

The first switch mount 24 carries a first safety switch 28 of the normally open type and a monitor switch 29 of the normally closed type, whereas the second switch mount 25 holds a second safety switch 30 having two contacts. Those switches are incorporated into the door locking assembly without disturbing the cooperation of the latch heads 3 and 4. The monitor switch 29 is under the control of an "L" shaped switch lever 31 which is movable by the depressing movement of the point of the latch head 3. An opening lever 32 as described below is secured adjacent the third opening 21 in the front plate 22.

Figure 3:
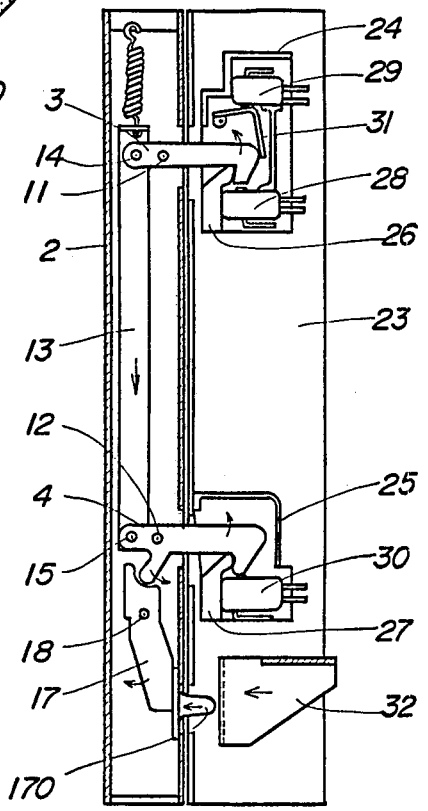
FIG. 3 is an elevational cross-sectional view of the principal part of the door locking configuration when a door is locked.

FIG. 3 is an elevational cross-sectional view showing the operating condition of the door latching assembly of FIG. 2 when the door 2 is in its closed position and locked into the body 1 of the microwave oven. Due to the engaging relationship between the first latch head 3 and the latch hook 26 and the second latch head 4 and the latch hook 27 the door 2 is locked in its closed position on the body 1 side. When this occurs, the first and second safety switches 28 and 30 are closed because their actuators are depressed by the points of the latch heads 3 and 4. The monitor switch 29, on the other hand, is previously open under the control of the rotating lever 31. The opening lever 32 is moved backward under the control of the projection 170 on the rotating lever 17.

The way in which the door 2 is released from its locked position on the body side 1 will now be described below.

Figure 4:
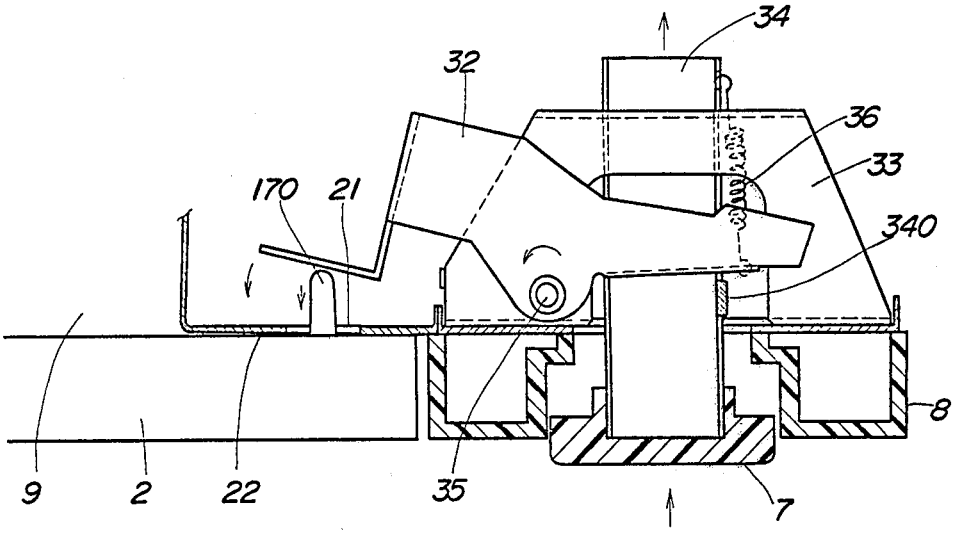
FIG. 4 is a cross-sectional plan view of a door opening configuration within the door latching assembly.

FIG. 4 is a cross-sectional plan view of a door opening configuration built in the door latching assembly embodying the present invention, wherein there is provided, at the back of the operational panel 8 on the body 1 side, an installation board 33 carrying a slide lever 34 movable forward and backward and the above mentioned opening lever 32 mounted on a pin 35. A spring 36 is provided to connect the opening lever 32 and the slide lever 34 together, always urging the slide lever 34 forward and allowing the door opening button 7 to extend from the operational panel 8.

The opening lever 32 stands as depicted in the drawings when the door 2 is in its closed position. If the door opening button 7 is actuated in the direction as defined by the arrow, then the slide lever 34 will retreat so that its accompanying projection 340 abuts the opening lever 32 and rotates the opening lever 32 counterclockwise. Under this condition the projection 170 is caused to move out and away from the third opening 21 in the front plate 22 within the oven cavity 9 and to rotate the rotating lever 17 clockwise (FIG. 3). This causes the first and second latch heads 3 and 4 to rotate counterclockwise in such a way as to dismount their respective fingers from the latch hooks 26 and 27.

After the latch heads 3 and 4 disengage from the latch hooks 26 and 27 and the door 2 is unlocked from the microwave body 1, the spring 16 raises the connection lever 13 and returns the latch heads 3 and 4 to their initial positions. Due to the force of the spring 16 the points of the latch heads 3 and 4 hit on inclined surfaces 260 and 270 of the latch heads 26 and 27. Accordingly, the door 2 is reactively urged forward in its opening direction. The door 2 is freed automatically from the oven body 1 in response to the actuation of the door opening button 7.

While the door is in the process of being unlocked, the first and second safety switches 28 and 30 are immediately opened and the monitor switch 29 is thereafter closed so that microwave oscillation comes to a stop prior to the opening of the door to prevent microwave energy from leaking from a spacing between the door 2 and the oven body 1.

Figure 5:
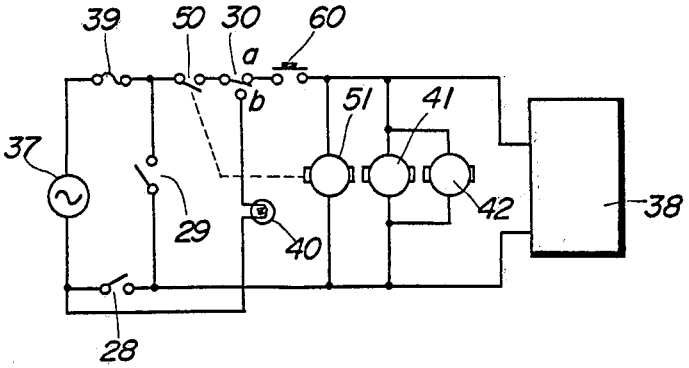
FIG. 5 is an electrical circuit diagram of the microwave oven.

An electrical wiring diagram of the microwave oven including the above mentioned switches is illustrated in FIG. 5. The first and second safety switches 28 and 30 are connected between a power supply 37 and a microwave oscillation circuit 38, while the monitor switch 29 is connected in parallel with the microwave oscillation circuit 38 and in series with the first safety switch 28. The second safety switch 30 is connected to the contact a and the contact b when the door is in its closed position and in its open position, respectively. Thus, when the door is open, an oven lamp 40 is energized for illumination of the interior of the oven 9 with light. The timer 5 on the operational panel 8 comprises a timer switch 50 and a timer motor 51 and is adapted to start a timekeeping operation when the cook button 6 is actuated and the cook switch 60 is closed. At the same time, the microwave oscillation circuit 38, a blower motor 41 and a turntable motor 42 are connected to the power supply 37, thus initiating the cooking operation.

In the event that the door is opened during the cooling operation, a power supply to the microwave oscillation circuit 38 is shut off in spite of the timer switch 50 in its closed position since the first and second safety switches 28 and 30 and the monitor switch 30 are operatively associated with the door locking configuration.

Figure 6:
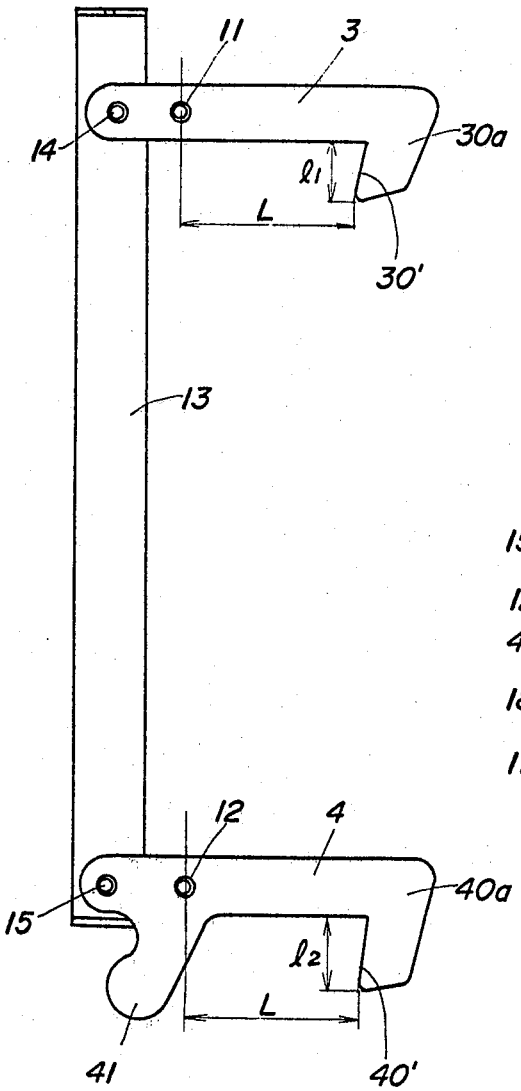
FIG. 6 is a partly enlarged side view of the door latching assembly.
Figure 7:
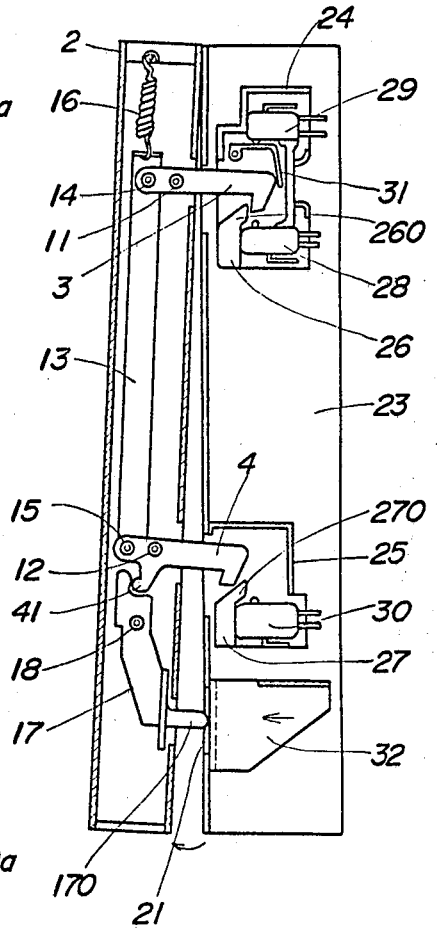
FIG. 7 is an elevational cross-sectional view of the door latching assembly when the door is warped.

As depicted in FIG. 6, it is desirable that the dimensions $l_1$ and $l_2$ of the engaging sides 30' and 40' of the fingers of the latch heads 3 and 4 with the latch hooks 26 and 27 is, for example, 5.5 mm and 6.5 mm, respectively. Thus the latch head 4 is longer than the latch head 3. That is, as described with respect to FIGS. 3 and 4, when the door opening button 7 is actuated to open the door 2, the opening lever 32 rotates counterclockwise to move the projection 170 backward and the latch heads 3 and 4 in the unlocking direction. However, in the event that there is any deviation from designed dimensions, the latch head 4 will first disengage from the latch hook 27 but at this time the other latch head 3 is still engaged with the latch hook 26 as shown in FIG. 7, resulting in a difference in the tie of the disengagement. Thus, an extreme case the unlocking of the door will be incomplete as viewed from FIG. 7 and a warped door 2 will be unable to open, even with the thrusting power of the opening lever 32.

To this end the dimension relationship as illustrated in FIG. 6 is choosen such that the latch head more remote from the opening lever 32 first disengages from the latch hook 26. Accordingly, the latch head 3 is the first to disengage and the latch head 4 is the last. In this case, even when the latch head 4 becomes late to disengage, the thrusting power of the opening lever 32, which was the cause of warp of the door, is exerted adjacent the latch head 4 to prevent the door from warping. It is obvious that the above mentioned dimensional difference is not necessarily required as long as the dimensions of the overall components are kept accurate during manufacture and assembly.

Figure 8:
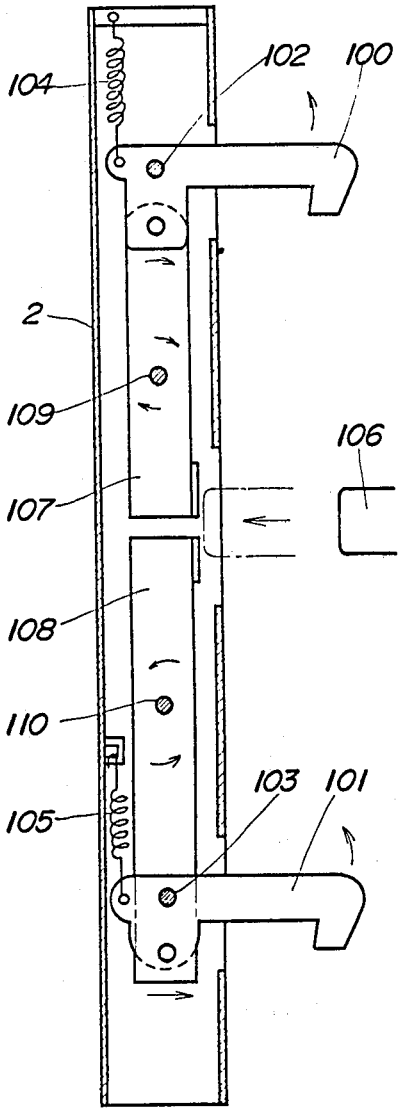
FIG. 8 is an elevational cross-sectional view of another preferred form of the present invention.

Other modified forms of the present invention will be explained by reference to FIGS. 8 and 9. In the example of FIG. 8, latch heads 100 and 101 are secured movable on the edge portion of the door 2 by the use of pins 102 and 103 and urged in the direction as depicted in the drawings under the influence of springs 104 and 105. When the door opening button is actuated, a door opening button 106 protrudes from the oven body and enters the interior of the door 2. The opening lever 106 rotates the rotating levers 107 and 108 about pins 109 and 110 in the arrow direction and moves the latch heads 100 and 101 counterclockwise. Of course, the latch heads 100 and 101 move the body and the door 2 is pushed in its opening direction in the same manner as discussed above under the influence of the springs 104 and 105.

Figure 9:
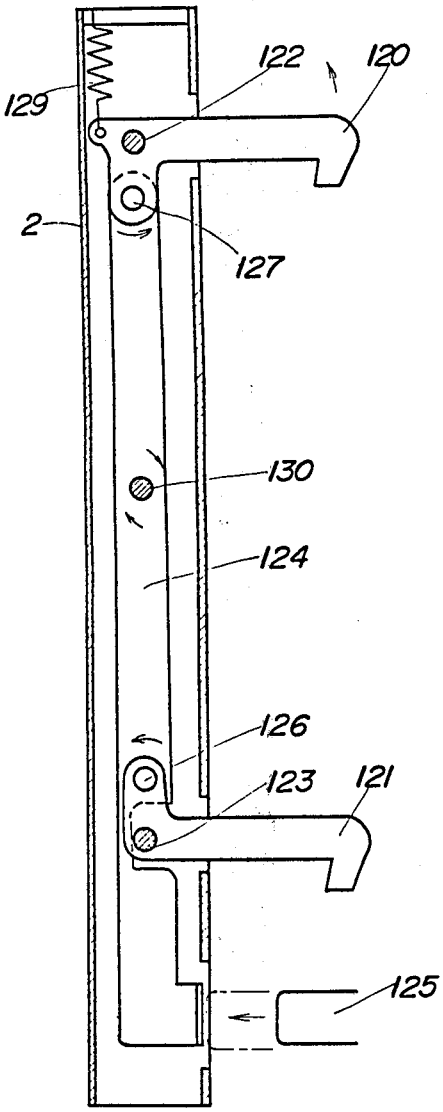
FIG. 9 is an elevational cross-sectional view of still another preferred form of the present invention.

In FIG. 9, latch heads 120 and 121 are movably secured on the edge portion of the door 2 by means of pins 122 and 123 and connected together through the utilization of a connection lever 124. When the door opening button is actuated, an opening lever 125 protrudes into the interior of the door 2 from the oven body, rotating the connection lever 124 clockwise about a pin 130. This causes the latch heads 120 and 121 to rotate counterclockwise around pins 126 and 127 to unlock the door 2 from the oven body side.

As noted earlier, the door latching assembly embodying the present invention is easy-handing since it employs the door opening actuator on the oven body side to open the door. When the door latching assembly is applied to microwave ovens, it is possible to shut off the power supply to a load before the door is opened. The door latching assembly is also clear of the problem with incomplete unlocking of the door.

In a sharp contrast to the prior art device (for example, U.S. Pat. No. 3,777,098), the latch hook (on the oven side) is of the fixed type for a smooth door opening operation according to the present invention. The prior art device suffered from unstable and jerky movement of the latch hooks, the switches, etc. and stringent accuracy is needed as regards the distance between the latch heads and microswitches. Moreover, in the prior art devices the latch head is urged downward by the force of a spring and the door is inclined to warp under the influence of that spring. The present invention is free of such problem.

Whereas the present invention has been described with respect to specific embodiments thereof, it will be understood that various changes and modifications will be suggested to one skilled in the art, and it is intended to encompass such changes and modifications as full within the scope of the appended claims.

I claim:

1. A microwave oven comprising an oven housing a door attached to the housing which can be operated between a closed and an opened position to provide access to the interior of said housing a door latching assembly for securing the door in a closed position; said door latching assembly containing a locking element movably mounted on the door for locking the door in a closed position, and an unlocking element movably mounted on the door so as to shift the locking element and thereby unlock the door, and actuating means mounted in said oven housing, and operable when the door is locked to move the unlocking element to unlock the door.

2. The microwave oven of claim 1 wherein the door latching assembly comprises first and second spring biased latch heads operatively connected together and pivotally mounted on the door, said latch heads acting against said bias to secure the door to the oven housing.

3. The microwave oven of claim 2 wherein lever means is rotatably attached to the door for engagement with the door latching assembly, said lever means being in operable engagement with the actuating means when the door is locked whereby upon the actuation of the actuating means, the lever means causes the door latching assembly to move against the bias and open the door.

4. The microwave oven of claim 2 wherein the latch head most remote from the actuating lever is so dimensional as to disengage from the oven housing immediately before the other latch head disengages therefrom.

* * * * *